US009855459B1

(12) United States Patent
Condara

(10) Patent No.: US 9,855,459 B1
(45) Date of Patent: Jan. 2, 2018

(54) VERSATILE GRIP POSITIONING (VGP) TRACK ASSEMBLY

(71) Applicant: Theodore J Condara, Houston, TX (US)

(72) Inventor: Theodore J Condara, Houston, TX (US)

( * ) Notice: Subject to any disclaimer, the term of this patent is extended or adjusted under 35 U.S.C. 154(b) by 33 days.

(21) Appl. No.: 14/476,734

(22) Filed: Sep. 3, 2014

Related U.S. Application Data

(60) Provisional application No. 61/873,193, filed on Sep. 3, 2013.

(51) Int. Cl.
*A63B 21/00* (2006.01)

(52) U.S. Cl.
CPC ..... *A63B 21/4035* (2015.10); *A63B 21/4049* (2015.10)

(58) Field of Classification Search
CPC ..... A63B 21/0772–21/075; A63B 21/4035; A63B 21/4049; A63B 23/1236
See application file for complete search history.

(56) References Cited

U.S. PATENT DOCUMENTS

| | | | | | |
|---|---|---|---|---|---|
| 3,384,370 | A * | 5/1968 | Bailey | A63B 21/0724 | 482/106 |
| 4,618,143 | A * | 10/1986 | Twardosz | A63B 21/0724 | 482/106 |
| 4,690,400 | A * | 9/1987 | Metz | A63B 21/015 | 482/106 |
| 4,822,035 | A * | 4/1989 | Jennings | A63B 21/0724 | 482/106 |
| 2003/0207740 | A1* | 11/2003 | Fenelon | A63B 21/075 | 482/107 |
| 2013/0035218 | A1* | 2/2013 | Wierszewski | A63B 21/4035 | 482/106 |
| 2013/0316886 | A1* | 11/2013 | Lynch | A63B 26/003 | 482/146 |

* cited by examiner

*Primary Examiner* — Jennifer M Deichl
(74) *Attorney, Agent, or Firm* — Nick A. Nichols, Jr.

(57) ABSTRACT

In a grip positioning apparatus a handle grip may be mounted in a tubular housing transverse to the rotational axis of the tubular housing. The handle grip may be rotated 360° in a single plane of motion controlled by user applied pressure to a lock/tension control member that may be manipulated to variably increase/decrease and/or maintain drag torque values throughout a desired range of motion. The handle grip may be locked at any desired angle relative to the rotational axis by the user applying and maintaining a grip pressure on the lock/tension control member. A detachable lock mechanism may be engaged prior to use to lock the handle grip at a selected angle. The grip positioning assembly may be mounted for use in a static, dynamic or multiple configurations.

10 Claims, 4 Drawing Sheets

VERSATILE GRIP POSITIONING (VGP) TRACK ASSEMBLY

CROSS-REFERENCE TO RELATED APPLICATION

This application claims the benefit of U.S. Provisional Application Ser. No. 61/873,193, filed Sep. 3, 2013, which application is incorporated herein by reference in its entirety.

BACKGROUND OF THE INVENTION

The present invention relates to exercise equipment and apparatus for handling bulky or heavy loads, more particularly, to a handle grip assembly that may rotate 360° in a single plane of motion controlled by a user of the handle grip assembly.

Exercise that requires the use of multiple muscle groups in coordinated movement may be considered the best exercise regimen to maximize the benefits of strength training. Training with free weights is preferred by many trainers over exercise machines because free weight training, in additions to strengthening muscles, helps in the development of balance and coordination. For example, barbell, bench press, pushup and the like exercises that require the coordination of a number of muscle groups, including for example, left and right arm, shoulder and back muscle groups may provide significant gains in strength and coordination.

SUMMARY OF THE INVENTION

In an embodiment of a handle grip positioning tracking assembly disclosed herein, a handle grip may be mounted in a tubular housing transverse to the rotational axis of the tubular housing. The handle grip may rotate 360° in a single plane of motion. Manipulation of a lock/tension control member movably mounted on a handle grip may variably increase/decrease and/or maintain drag torque values throughout a desired range of motion. The handle grip may be locked at any desired angle relative to the rotational axis by applying and maintaining grip pressure on the lock/tension control member. A detachable lock mechanism may be engaged prior to use to lock the handle grip at a selected angle. The handle grip positioning tracking assembly disclosed hereinafter may be mounted for use in static, dynamic or multiple configurations.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF ILLUSTRATIVE EMBODIMENTS

Figure 1:
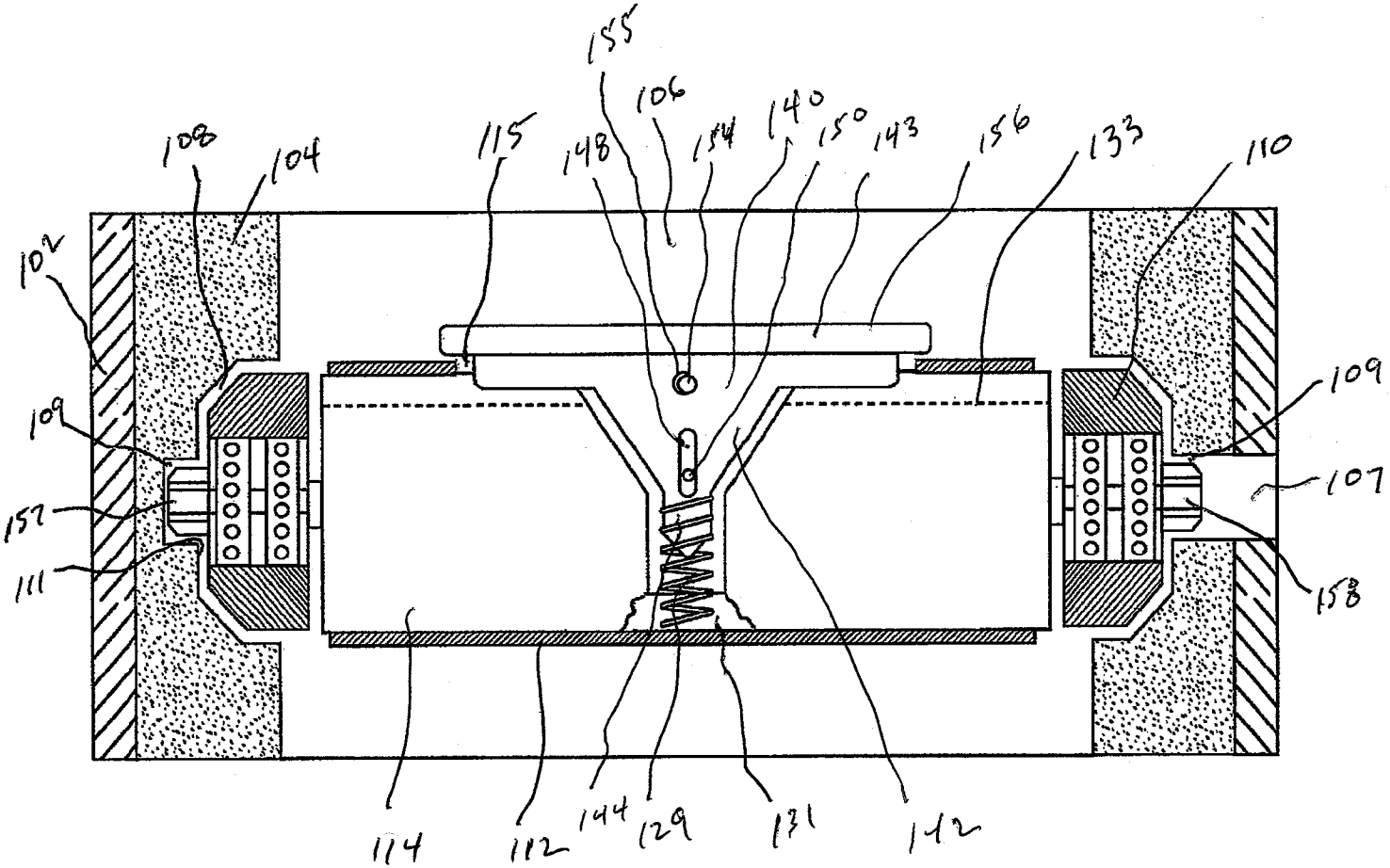
FIG. 1 is a section view of a grip positioning assembly.

Referring first to FIG. 1, a versatile grip positioning track assembly is generally identified by the reference numeral 100. The grip positioning assembly 100 may include a housing 102 having a tubular configuration, such as a steel tube or pipe and the like. A track member 104 may be press fit into the housing 102. The track member 104 is concentric with the housing 102. Upon assembly with the housing 102, the outer surface of the track member 104 frictionally engages the inner surface of the housing 104 thereby fixedly securing the track member 104 to the housing 102 essentially forming a single component open at both ends circumscribing an axial bore 106 extending therethrough. A hole 107 may be drilled through the housing 102 and the track member 104 to provide access for tightening a lock nut upon final assembly of the grip positioning track 100 described in greater detail hereinafter.

The track member 104 may be fabricated of a wear-resistant material that provides an impact-resistant wear surface having superior wear resistance and self lubricating characteristics, such as the Nylatron® nylon product. The track member 104 may be machine cut to include a circumferential roller path track 108 and a lock nut path track 109 cut into the base wall 111 of the roller path track 108. The roller path track 108 may be configured to match the profile of a bearing roller housing 110.

The assembly 100 may include a handle grip housing 112. The housing 112 defines a substantially cylindrical body open at both distal ends thereof. A longitudinal slot 115 providing access to the interior of the grip housing 112 may be cut through the cylindrical wall of the housing 112. The grip housing 112 is sized and configured to receive inserts 114, shown in greater detail in FIGS. 2A-2E. One insert 114 is shown in FIGS. 2A-2E, however, it is understood that two inserts 114 are housed within the grip housing 112, as shown in FIG. 1. The inserts 114 are substantially cylindrically shaped and sized to fit within the grip housing 112 but are free to move relative to the grip housing 112. Each insert 114 includes a first distal end defined by a substantially planar surface 116 oriented transverse to the rotational axis of the insert 114. The oppositely facing second distal end of each insert 114 is defined by a tapered surface 118 extending downwardly and outwardly from the exterior surface of the insert 114 to the upper end of a squared off planar surface 120 oriented transverse to the rotational axis of the insert 114.

A roller axle 122 extends radially outwardly from planar surface 116 of each insert 114. The axle 122 may be threadedly secured to the insert 114 at a threaded collar 124 fixed to the surface 116 of the insert 114 by welding and the like or integrally formed therewith. The distal end of the axle 122 may included a threaded portion 126.

Figures 2A, 2B, 2C, 2D, 2E:
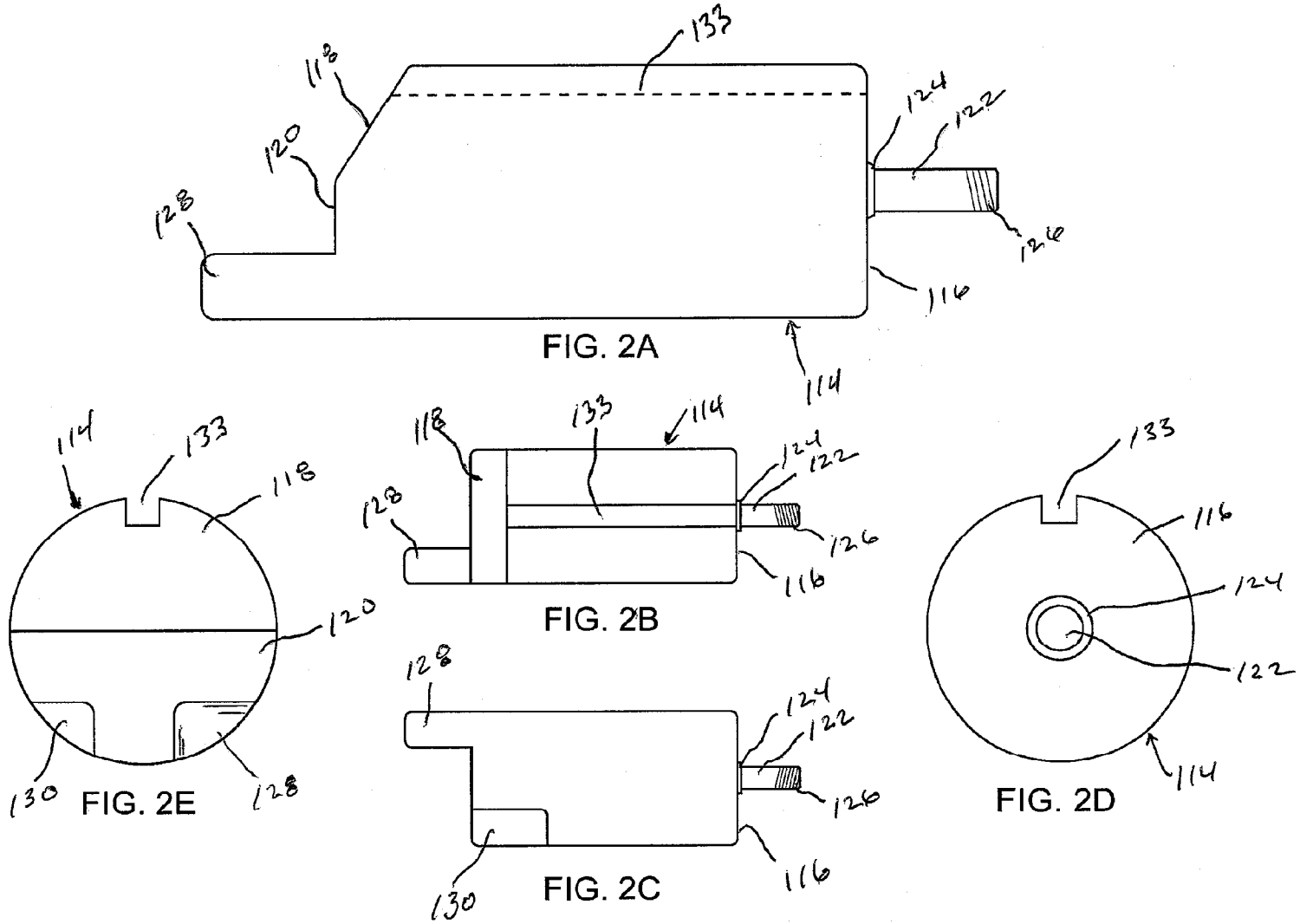
FIG. 2A is a side view of a component of the grip positioning assembly shown in FIG. 1.
FIG. 2B is a top plan view of the component shown in FIG. 2A.
FIG. 2C is a bottom plan view of the component shown in FIG. 2A.
FIG. 2D is an end view of a first distal end of the component shown in FIG. 2A.
FIG. 2E is an end view of a second distal end of the component shown in FIG. 2A.

The second end of the insert 114 may include an extension 128 projecting outwardly from the surface 120 and a machined slot 130 extending inwardly from the surface 120 at the edge of the insert 114 opposite the tab 128, more clearly shown in FIG. 2E. The extension 128 and the slot 130 are laterally spaced from the longitudinal center axis of the insert 114 and extend substantially parallel thereto. The slot 130 of one insert 114 is sized to receive the extension 128 of the other insert 114. Upon assembly of the inserts 114 inside the grip housing 112, shown in FIG. 1, the extensions 128 of the two inserts 114 are in a spaced relationship relative to one another and form a chamber 131 bound by the extensions 128 and the squared off planar surfaces 120 of the inserts 114. The chamber 131 is sufficiently sized receive a spring 129 disposed between the inserts 114.

Figure 3:
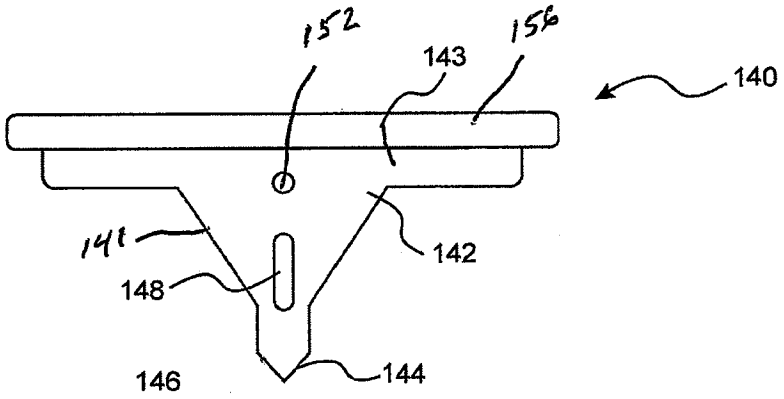
FIG. 3 is a front plan view of a lock/tension control member of the grip positioning assembly shown in FIG. 1.

Referring now to FIG. 3, a lock/tension control member 140 may comprise a substantially T-shaped steel plate 142. An upper portion of the plate 142 forms the substantially horizontally extending T-cap crossbar 143 of the T-shaped control member 140. The side edges 141 of the control member 140 are angularly tapered inward and downward from the T-cap crossbar 143 and terminate at a downwardly extending control member lobe 144. The lower distal end of the lobe 144 may be defined by a centered point 146. The control member 140 includes a substantially vertically extending slot 148 for receipt of a retainer pin 150 (shown in FIG. 1) therethrough. The control member 140 further includes a hole 152 spaced above and in substantial vertical alignment with the slot 148. to accommodate a removable lock pin 154 that may be inserted through the hole 152 to lock the control member 140 at a desired angle. A snap type cotter pin 155 may be provided to secure the lock pin 154 to the control member 140. A hand grip contact pad 156, preferably a stretch slip fit composite, may be glued or otherwise attached to the T-cap crossbar 143 of the control member 140.

Assembly of the grip positioning track 100 begins with press fitting the track member 104 into the housing 102. A hole 107 may be drilled through the housing 102 and track member 104. The hole 107 opens into the lock nut path track 109. A double bearing roller 110 may then be inserted in the roller path track 108 and the bore extending through the bearing roller 110 aligned with the side drilled hole 107. The grip housing 112 may then be assembled by inserting the first insert 114 into the grip housing 112. The second bearing roller 110 is installed on the axle 122 of the first insert 114. An axle nut 157 may then be threaded on the end 126 of the axle 122 and tightened. Next the spring 129 may be positioned in the area adjacent to the insert planar surface 120 that will form the chamber 131 between the insert extensions 128. The second insert 114 may then be inserted into the housing 112 in spaced facing relationship with the first insert 114. An adjustment of the alignment of the inserts 114 may be required to ensure that the spring 129 is centrally positioned. The inserts 114 are then pushed together so that the extensions 128 are inserted in the respective machined slots 130 of the inserts 114 and the inserts 114 positioned so that the longitudinal groove 133 cut into the inserts 114 are aligned with the longitudinal slot 115 in the grip housing 112. The control member 140 may then be installed by inserting the T-shaped steel plate 142 through the grip housing slot 115 until the lobe 144 engages the spring 129. Assembly continues by maintaining light pressure on the control member 140 and inserting the axle end of the first insert 114, including the double roller 110 mounted on the axle 122 and axle nut 157, into the roller path track 108 and lock nut path track 109 directly opposite the roller bearing 110 aligned with the side drilled bore 107. The axle 122 of the second insert 114 is then aligned with the roller bearing 110 and the bore 107. Increased pressure on the control member 140 advances the second insert 114 so that the axle 122 passes through the bore of the double roller bearing 110 and into the bore 107. The control member 140 is retained in its position by inserting the retainer pin 150 through the grip housing 112 and the slot 148. A snap type cotter pin may be installed to lock the retainer pin 150 in place. Assembly of the apparatus 100 is completed by threading a lock nut on the end 126 of the axle 122 extending into the bore 107.

Figure 4:
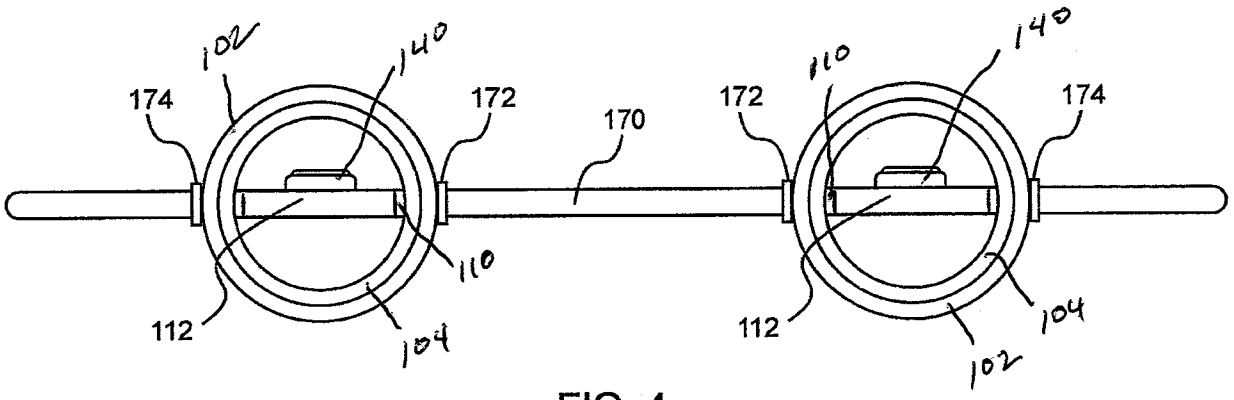
FIG. 4 is an end view of two grip positioning assemblies arranged in a barbell configuration.

The grip positioning track assembly 100 may be used in static, dynamic or multiple configurations. For example, the assembly 100 illustrated in FIG. 4 may be used to perform various exercises, such as the curl, military and bench press exercises. The exercises may be performed normally, however, the assembly 100 permits exercise of the forearms of the user by rotating the forearms as the barbell is raised and lowered. In FIG. 4, two apparatus 100 are joined by a bar 170 to form a barbell 200. The apparatus 100 include threaded collars 172, 174 mounted on opposite sides of the housing 102. The collars 172, 174 are aligned relative to one another. The opposite distal ends of bar 170 may be threaded to the collars 172 to form the barbell 200.

Figure 5:
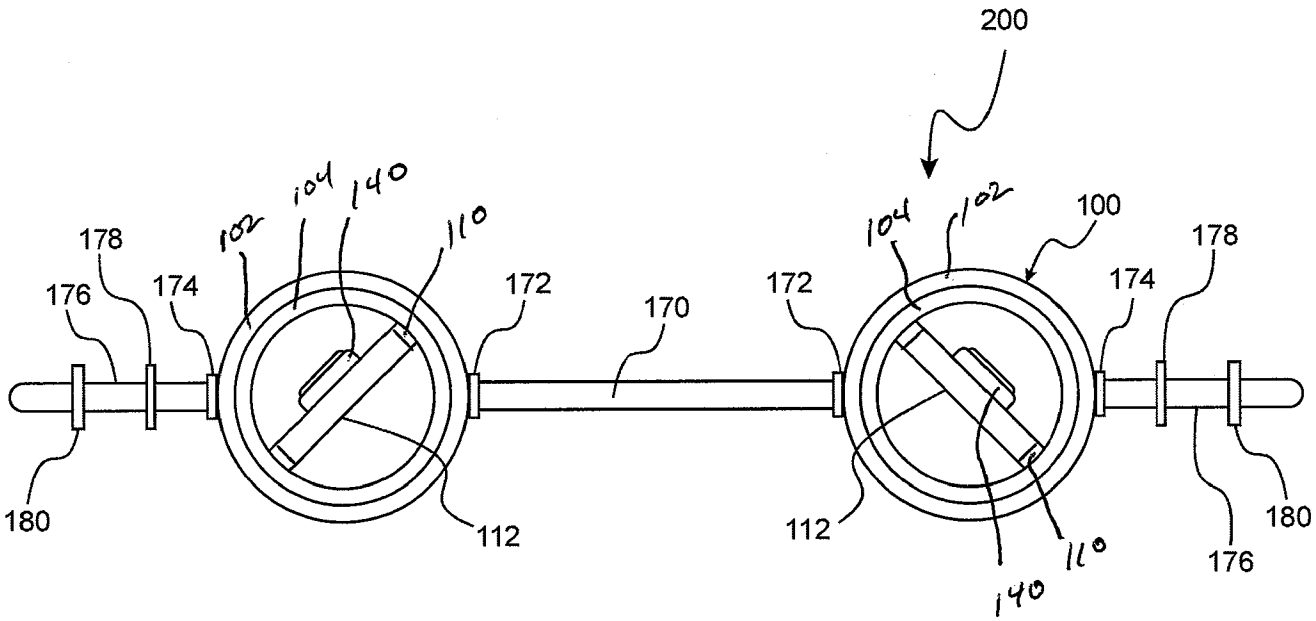
FIG. 5 is an end view of two grip positioning assemblies arranged in a barbell configuration to accommodate additional weights.

Weight plates may be added on extension members 176 threaded to the collars 174 to increase the weight of the barbell 200, as shown in FIG. 5. The weight plates may be removably secured on the extension members 176 between retaining collars 178 and retaining nuts 180 mounted on the extension members 176 in a manner known in the prior art. It will be observed that the grip handles in FIG. 5 are depicted at an angular position.

While a preferred embodiment of the invention has been shown and described, other and further embodiments of the invention may be devised without departing from the basic scope thereof, and the scope thereof is determined by the claims which follow.

The invention claimed is:

1. A grip positioning apparatus, comprising:

a) a tubular housing having a longitudinal axis;

b) a track member concentrically received in said tubular housing, said track member fixedly secured to said tubular housing by frictional engagement with said tubular housing;

c) a hand grip rotatably supported by said track member transverse to said longitudinal axis of said tubular housing; and d) said hand grip including a control mechanism responsive to user applied pressure for adjusting drag torque upon rotation of said hand grip about said longitudinal axis of said tubular housing; and e) said hand grip further including:

i) a tubular grip housing;

ii) a pair of inserts slidably received in said grip housing, said inserts including a first distal end defining a substantially vertical planar surface, and a second distal end wherein an upper portion of said second distal end tapers toward a substantially planar vertically extending lower portion of said second distal end;

iii) each said inserts including a tab projecting outwardly from said lower portion of said second distal end of said inserts and a slot extending inwardly from an edge of said lower portion of said second distal end, said slot laterally spaced from and substantially parallel to said tab and an axle extending outwardly from said first distal end of a respective said inserts; and f) a bearing roller rotatably supported by each said inserts proximate a distal end of a respective said axle.

2. The apparatus of claim 1 wherein said control mechanism includes a substantially planar plate extending downwardly from a T-cap upper portion of said control mechanism, terminating at a distal extension of said control mechanism.

3. The apparatus of claim 1 including a lock member for locking said hand grip in a fixed position relative to said tubular housing.

4. The apparatus of claim 1 wherein said track member includes a circumferential track, wherein said bearing roller of each said inserts is selectively movable into engagement with said track member.

5. A grip positioning apparatus, comprising:

a) a tubular housing having a longitudinal axis;

b) a cylindrical hand grip rotatably supported within said tubular housing transverse to said longitudinal axis; and c) said hand grip including:

i) a tubular grip housing;

ii) a pair of inserts slidably received in said grip housing, said inserts including a first distal end defining a substantially vertical planar surface, and an oppositely facing second distal end, wherein an upper portion of said second distal end tapers toward a substantially planar vertically extending lower portion of said second distal end;

iii) a tab projecting outwardly from said lower portion of said second distal end of a respective said inserts and a slot extending inwardly from an edge of said lower portion of said second distal end of a respective said inserts, said slot laterally spaced from and substantially parallel to said tab, and an axle extending outwardly from said first distal end of a respective said inserts; and d) a bearing roller rotatably supported by each said inserts proximate a distal end of a respective said axle.

6. The apparatus of claim 5 including a lock pin for selectively locking said hand grip in a fixed position relative to said tubular housing.

7. The apparatus of claim 5 wherein said tubular housing includes an internal circumferential track configured for movably supporting said hand grip in a plane extending transverse to said longitudinal axis of said tubular housing.

8. The apparatus of claim 7 wherein said pair of inserts are in concentric spaced relationship to one another, and further including a control mechanism responsive to user applied pressure, wherein manipulation of said control mechanism advances said pair of inserts in opposite outward directions into engagement with said track.

9. The apparatus of claim 5 including a cylindrical track member concentrically received in said tubular housing, said cylindrical track member fixedly secured to said tubular housing by frictional engagement with an inner surface of said tubular housing.

10. A grip positioning apparatus, comprising:

a) a tubular housing having a longitudinal axis;

b) a hand grip movably supported by said tubular housing transverse to said longitudinal axis of said tubular housing;

c) a control mechanism responsive to user applied pressure for varying drag torque upon rotation of said hand grip about said longitudinal axis of said tubular housing;

d) said tubular housing including an internal circumferential track configured for movably supporting said hand grip;

e) a first insert and a second insert slidably received in said hand grip in concentric spaced relationship to one another, said first insert and said second insert including a first distal end defining a substantially vertical planar surface;

f) an axle extending radially outwardly from said first distal end of a respective said first and second insert; and g) a bearing roller rotatably supported by each said first and second insert proximate a distal end of a respective axle.

* * * * *